US006035925A

United States Patent [19]

Blucher

[11] Patent Number: 6,035,925

[45] Date of Patent: Mar. 14, 2000

[54] GATING SYSTEM FOR CONTINUOUS PRESSURE INFILTRATION PROCESSES

[75] Inventor: Joseph T. Blucher, Waltham, Mass.

[73] Assignee: Northeastern University, Boston, Mass.

[21] Appl. No.: 09/054,299

[22] Filed: Apr. 2, 1998

Related U.S. Application Data

[62] Division of application No. 08/760,974, Dec. 5, 1996, Pat. No. 5,736,199.

[51] Int. Cl.[7] ..... B22D 19/00; B05C 3/02

[52] U.S. Cl. ..... 164/419; 164/461; 118/400; 118/405; 118/423

[58] Field of Search ..... 164/461, 419; 427/430.1, 434.6, 434.7; 118/400, 405, 423

[56] References Cited

U.S. PATENT DOCUMENTS

| | | | |
|---|---|---|---|
| 3,619,145 | 11/1971 | Crawford et al. | 23/285 |
| 3,650,042 | 3/1972 | Boerger et al. | 34/148 |
| 3,663,356 | 5/1972 | Li | 161/225 |
| 3,695,335 | 10/1972 | Cannell et al. | 164/97 |
| 3,813,260 | 5/1974 | Lipstein | 427/432 |
| 3,842,896 | 10/1974 | Dobo | 164/86 |
| 3,852,879 | 12/1974 | Krock et al. | 29/630 C |
| 3,898,918 | 8/1975 | Carter | 92/92 |
| 3,981,162 | 9/1976 | Klier | 68/5 E |
| 4,073,870 | 2/1978 | Saji et al. | 423/447.6 |
| 4,095,974 | 6/1978 | Matovich | 75/0.5 B |
| 4,113,166 | 9/1978 | Olsson | 228/170 |
| 4,191,127 | 3/1980 | Herman | 118/57 |
| 4,270,317 | 6/1981 | Kurie | 51/426 |
| 4,479,530 | 10/1984 | Ekerot | 164/461 |
| 4,649,856 | 3/1987 | Shannon et al. | 118/712 |
| 4,681,151 | 7/1987 | Koya et al. | 164/76.1 |
| 4,705,466 | 11/1987 | Balassa | 425/6 |
| 4,773,654 | 9/1988 | Fritsch | 277/3 |
| 4,844,147 | 7/1989 | Tominaga et al. | 164/450 |
| 5,007,474 | 4/1991 | Langensiepen et al. | 164/97 |
| 5,085,945 | 2/1992 | Yun et al. | 428/614 |
| 5,119,864 | 6/1992 | Langensiepen et al. | 164/97 |
| 5,167,271 | 12/1992 | Lange et al. | 164/103 |
| 5,188,164 | 2/1993 | Kantner et al. | 164/97 |
| 5,197,528 | 3/1993 | Burke | 164/97 |
| 5,240,062 | 8/1993 | Langensiepen et al. | 164/97 |
| 5,249,621 | 10/1993 | Aghajanian et al. | 164/97 |
| 5,280,819 | 1/1994 | Newkirk et al. | 164/98 |
| 5,322,109 | 6/1994 | Cornie | 164/97 |
| 5,377,741 | 1/1995 | Burke | 164/97 |
| 5,427,172 | 6/1995 | Ekerot | 164/461 |
| 5,439,627 | 8/1995 | De Jager | 264/129 |
| 5,487,420 | 1/1996 | Newkirk | 164/97 |
| 5,500,244 | 3/1996 | Rocazella et al. | 427/181 |
| 5,511,603 | 4/1996 | Brown et al. | 164/97 |

FOREIGN PATENT DOCUMENTS

| | | |
|---|---|---|
| 0304167 | 2/1989 | European Pat. Off. . |
| 58-6029433 | 7/1983 | Japan . |

*Primary Examiner*—Nina Bhat

*Attorney, Agent, or Firm*—Weingarten, Schurgin, Gagnebin & Hayes LLP

[57] ABSTRACT

A system of gating orifices for continuous pressure infiltration processes eliminates blow-out of the pressurized molten metal matrix material and friction damage to the infiltrated perform. The system includes three or more orifices along a vertical path of an upwardly moving perform which passes from vacuum or atmospheric pressure into a pressurized infiltrating bath of molten metal, then into a pressurized atmosphere in which the matrix fully solidifies, and from there to an atmospheric environment. The entering orifice, at the bottom of the pressurized bath, is elongated in the direction of the perform movement to provide a temperature gradient from above the matrix material melting temperature at the bath to below the solidification temperature farthest from the bath. The resulting liquid-mushy-solid sequence of the matrix material forms a solidification seal to prevent blow out of the pressurized molten metal. Another elongated orifice(s), at the top of the bath, also has a temperature gradient to control the solidification of the matrix material in the infiltrated perform. This orifice does not function as a pressure seal. An uppermost orifice, not involved in the solidification process, seals against gas losses around the fully solidified composite. By separating the solidification and pressure sealing processes of the exiting orifices, molten metal blow out is prevented and friction-caused problems between the solidification gates and the traveling perform are eliminated.

11 Claims, 5 Drawing Sheets

GATING SYSTEM FOR CONTINUOUS PRESSURE INFILTRATION PROCESSES

This application is a divisional application Ser. No. 08/760,974 filed Dec. 5, 1996, now U.S. Pat. No. 5, 736,199.

BACKGROUND OF THE INVENTION

One method of manufacturing fiber reinforced metal matrix composite material is by the pressure infiltration process. In this process, fiber performs are infiltrated under high pressure with molten metal. The high pressure is necessary to compensate for the non wetting conditions existing between the reinforcing materials, frequently ceramics, and the molten metal matrix materials.

Typically, the infiltration is done in batches, in which the perform is infiltrated in a pressurized molten metal bath. For example, a perform is placed in a container, a block of metal is placed over the perform, and the temperature and pressure are raised, thereby melting the metal and causing it to infiltrate the perform.

A difficulty arises with continuous processes in which the perform must travel without interruption into, through, and out of the metal bath, in that the entry and exit openings to the bath have not hitherto been satisfactorily sealed to prevent the pressurized molten metal from blowing out of the bath through the openings. Thus, it has been impossible to produce continuous long pieces such as wires, tapes, sheets, or other structural shapes.

An example of a continuous process is given in European Patent Application No. EP 0 304 167 A2. However, at the exit gate, high friction forces cause fast deterioration of orifices and failure of the perform.

SUMMARY OF THE INVENTION

One solution to eliminating blow out has been to provide a temperature gradient in an entering orifice and an exiting orifice to a bath container of molten matrix material in a pressure chamber through which the perform travels, as shown-in FIG. 4. The temperatures of the ends of the orifices closest to the bath container are above the melting temperature $T_m$ of the matrix material in the bath, and the temperatures of the ends farthest from the bath container are below the solidification temperature $T_s$. Due to the temperature gradients, zones of the metal form in the orifices in which the metal exists in varying states from solid to "mushy" to liquid. The liquid zone is adjacent to the bath and the solid zone is farthest. From the bath. The zones themselves are stationary relative to the orifices, although metal dragging along with the perform continuously passes through the zones, changing states as determined by its location along the orifice. The mushy zone, in which liquid and solid states are both present, forms an effective seal adjacent the traveling perform to prevent metal blow out.

Along the entering orifice, the traveling perform first encounters the solid zone, then the mushy zone, then the liquid zone. The perform encounters relatively low frictional resistance against this orifice, since any pieces of metal in the solid zone which break off are carried back into the mushy and liquid zones where they remelt. However, a disadvantage of this embodiment is that along the exiting orifice, this sequence is reversed, such that the traveling perform first encounters the liquid zone, then the mushy zone, and finally the solid zone. This sequence combined with the pressure in the molten metal bath result in high frictional forces between the now impregnated perform and the orifice, which in turn causes chemical and/or mechanical welding between the perform and the orifice and consequent failure of the orifice and/or perform.

The present invention eliminates or substantially decreases the frictional forces between the traveling perform and the exiting orifice and consequently failures of the perform are reduced. More specifically, the perform enters the pressurized molten metal bath in a vertically upward direction through an entering orifice. The orifice is a channel having a cross-sectional configuration closely conformed to that of the perform. The length of the entering orifice is such that a temperature gradient with upper limit of above the melting temperature or liquids limit and lower limit below the solidification temperature or solids limit of the matrix material can be generated along the moving perform material. The perform enters the orifice from a low pressure region, preferably a vacuum, although atmospheric pressure is acceptable. While moving through the continuously reforming solid and mushy zones, the mushy zone acts as a solidification seal and prevents blow out of the pressurized molten metal. The perform is infiltrated as it passes through the molten metal bath.

At the top of the bath, the perform travels through an elongated first or solidification exiting orifice. At the lower part of this orifice, the temperature is the same or close to the temperature of the infiltration bath. At the upper part of the orifice, the temperature is at or slightly above the solidification temperature of the matrix material. Complete solidification of the infiltrated metal in the perform does not occur in the orifice. Therefore, friction between the moving perform and the orifice wall is insignificant. Complete solidification of the matrix material occurs after exiting from the orifice in the pressurized environment above the molten metal bath.

The impregnated and solidified perform then exits from the pressure chamber through a sealing exiting orifice whose only function is to prevent excessive gas losses. On entering this orifice, the perform is fully solidified and has well defined geometries; therefore, gas pressure sealing is simple. By separating the solidification and pressure sealing processes of the exiting orifices, molten metal blow out is prevented and friction-caused problems between the solidification gates and the traveling perform are eliminated.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Figure 1:
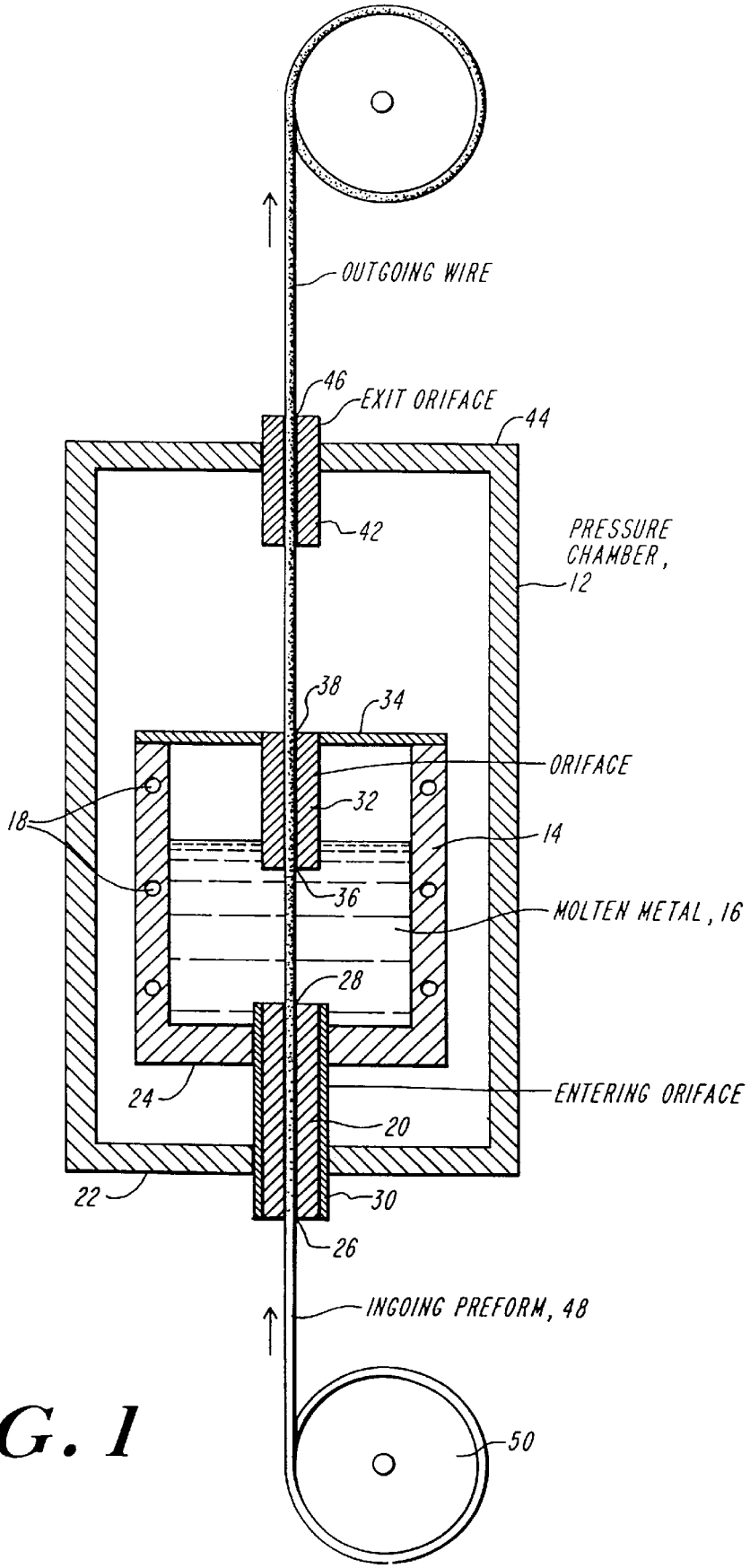
FIG. 1 is a schematic cross-sectional view of the gating system for a continuous pressure infiltration process of the present invention.

Referring to FIG. 1, the pressure infiltration system includes a pressure chamber 12 in which a bath container 14 is provided to hold a bath 16 of a molten metal matrix material, such as aluminum. Heating elements 18 are provided around or in the walls of the container 14 to melt the metal contained therein. The heating elements may comprise resistant, radiant, or induction elements or any other suitable heating device known in the art.

An elongated entering orifice 20 is provided in a floor 22 of the pressure chamber 12 which extends into the floor 24 of the bath container 14. Preferably, an inlet 26 of the entering orifice is located in a vacuum or low pressure chamber, although it can be in an atmospheric environment as well. An outlet 28 of the entering orifice 20 is located within the bath chamber 14, in contact with the molten metal.

The length of the entering orifice 20 is chosen to allow provision of a temperature gradient along its length such that the temperature is above the melting temperature or the liquids limit nearest the bath chamber and below the solidification temperature or the solids limit farthest from the bath chamber. The length of the orifice can be selected to provide a desired temperature gradient. A cooling jacket 30, such as a water cooled jacket, may be provided around the orifice 20 if desired to aid in obtaining the appropriate temperature gradient. In this way, the matrix material in the orifice 20 near the outlet 28 within the bath is in the liquid state, the matrix material near the inlet is in the solid state, and the matrix material in between is in a mushy state (both solid and liquid states are present).

Figure 2:
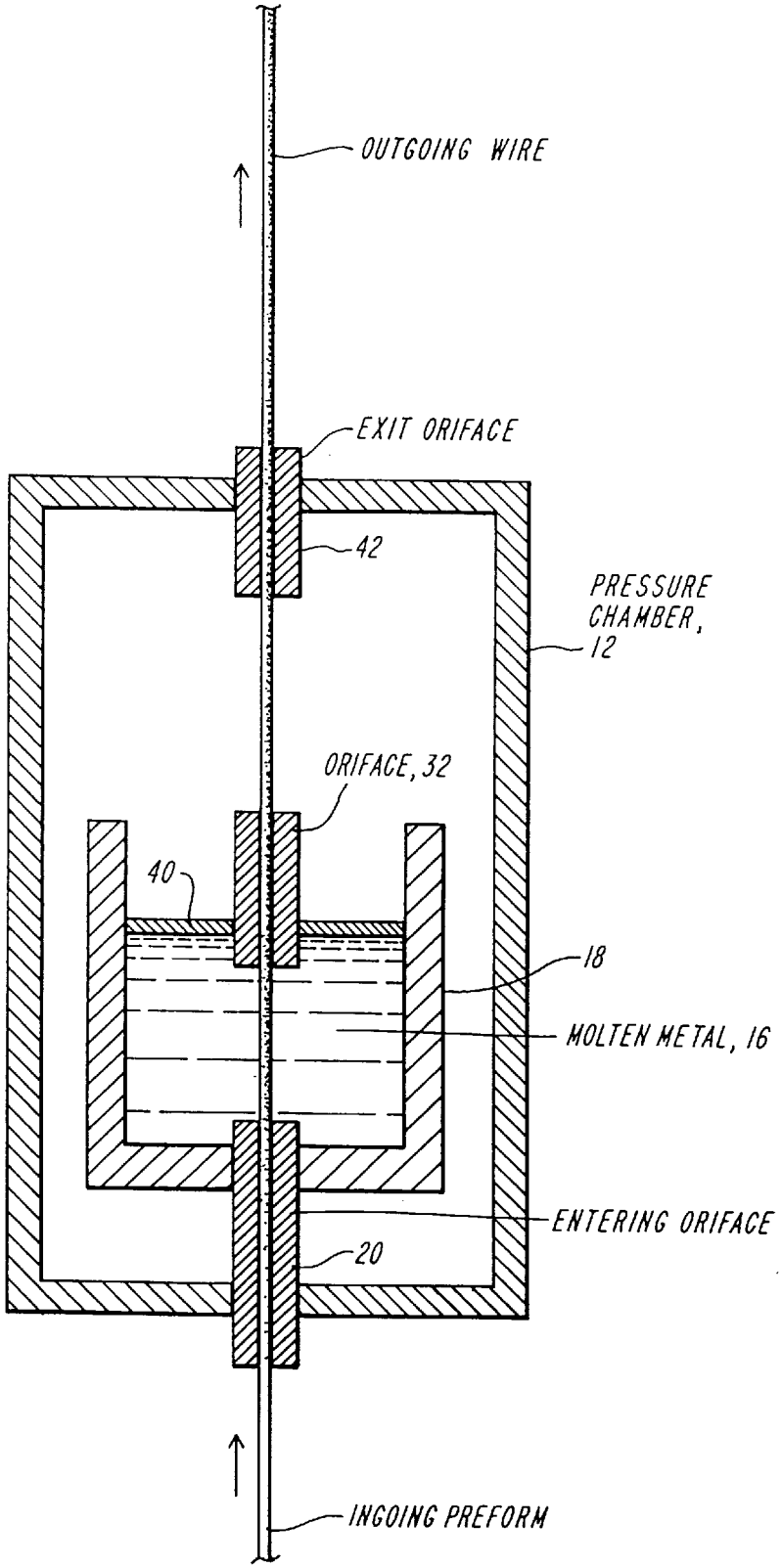
FIG. 2 is a schematic cross-sectional view of an alternative embodiment of the gating system for the continuous pressure infiltration process of the present invention.

A first elongated exiting orifice 32 is provided at the top of the molten bath 16 in the bath container 14. The orifice 32 may be supported at the top of the bath in any suitable manner, such as by struts 34 fixed to the bath container 14. The first exiting orifice extends from an inlet 36 within the bath chamber 14 to an outlet 38 in the environment above the bath in the pressure chamber 12. Preferably the inlet 36 is disposed within the molten matrix material. In this manner, slag which may form on the surface of the bath, such as aluminum oxide if aluminum is the matrix material, does not get dragged out of the bath with the infiltrated perform. Toward this end, in an alternative embodiment, shown in FIG. 2, the exiting orifice 32 may include a structure 40 enabling it to float on top of the bath 16 so that its elevation varies with the level of the bath and the top of the bath does not drop below the inlet 36.

The length of the first exiting orifice 32 is chosen to allow provision of a temperature gradient along its length such that the temperature is above the matrix material's melting temperature or liquids limit nearest the bath chamber and between the melting and solidification temperatures or between the liquids limit and the solids limit farthest from the bath chamber. Thus, the metal matrix material is in a mushy state (both solid and liquid states are present) at the outlet. Since the outlet 38 of the orifice is farthest from the bath, it is of necessity cooler than the inlet 36. Thus, the length of the orifice can generally be selected to ensure that matrix material at the outlet is in the mushy state. However, as with the entering orifice, a cooling jacket, such as a water cooled jacket, may be provided around the orifice if desired to aid in obtaining the appropriate temperature gradient.

A second elongated exiting orifice 42 is provided in a ceiling 44 of the pressurized chamber 12. The second exiting orifice acts to seal the pressure chamber from excessive gas losses and has a length chosen to effect such sealing. As with the orifices 20 and 32 above, a cooling jacket may be provided around the orifice 42 if desired. An outlet 46 of the second exiting orifice may be and preferably is located in an atmospheric environment.

Each of the elongated orifices 20, 32, and 42 has a configuration which conforms closely to the configuration of the perform being impregnated. If desired, the orifices may also be tapered slightly from narrow to wide in the direction of perform travel, to further decrease frictional forces.

To begin infiltration, a solid block of metal matrix material is provided with a through hole in the middle. The block is placed in the bath container 14 and a perform 48 is threaded through the entering orifice, the hole in the solid metal, and the first and second exiting orifices. A short section at the beginning of the perform may be solidified with an epoxy compound to make the threading easier. After the perform has been threaded, the metal block is melted by heat exchange with the heating elements 18 surrounding the bath container 14 and the pressure chamber 12 is pressurized. An inert gas, such as argon, may be introduced into the pressure chamber 12 to provide an inert environment to minimize reactions such as oxidation of the metal matrix material. The perform 48 is then moved continuously through the infiltrating bath and the pressure chamber by outside handling equipment 50, illustrated schematically in FIG. 1.

The perform 48 enters the entering orifice 20 and moves through continuously reforming solid, mushy, and liquid zones in the orifice. The mushy zone acts as a solidification seal and prevents blow out of the pressurized molten metal. The perform is infiltrated as it travels through the bath 16 of molten metal in the bath chamber.

At the top of the bath the perform enters the first exiting orifice 32. At and adjacent to the inlet 36 of this orifice, the temperature is the same or close to the temperature of the bath. At the outlet 38 of this orifice 32, the temperature is at or slightly above the solidification temperature of the matrix material. Thus, complete solidification of the infiltrated perform does not occur in this exiting orifice, and friction between the moving perform and the orifice wall is therefore insignificant. However, this orifice aids in shaping the infiltrated perform to the proper configuration. Complete solidification of the perform occurs in the environment above the bath in the pressure chamber after leaving the exiting orifice.

The impregnated and solidified perform exits from the pressurized chamber 12 through the second exiting orifice 42. At this stage, the perform is completely solidified and has well defined geometries. The second exiting orifice prevents excessive gas losses from the pressurized chamber.

Figure 3:
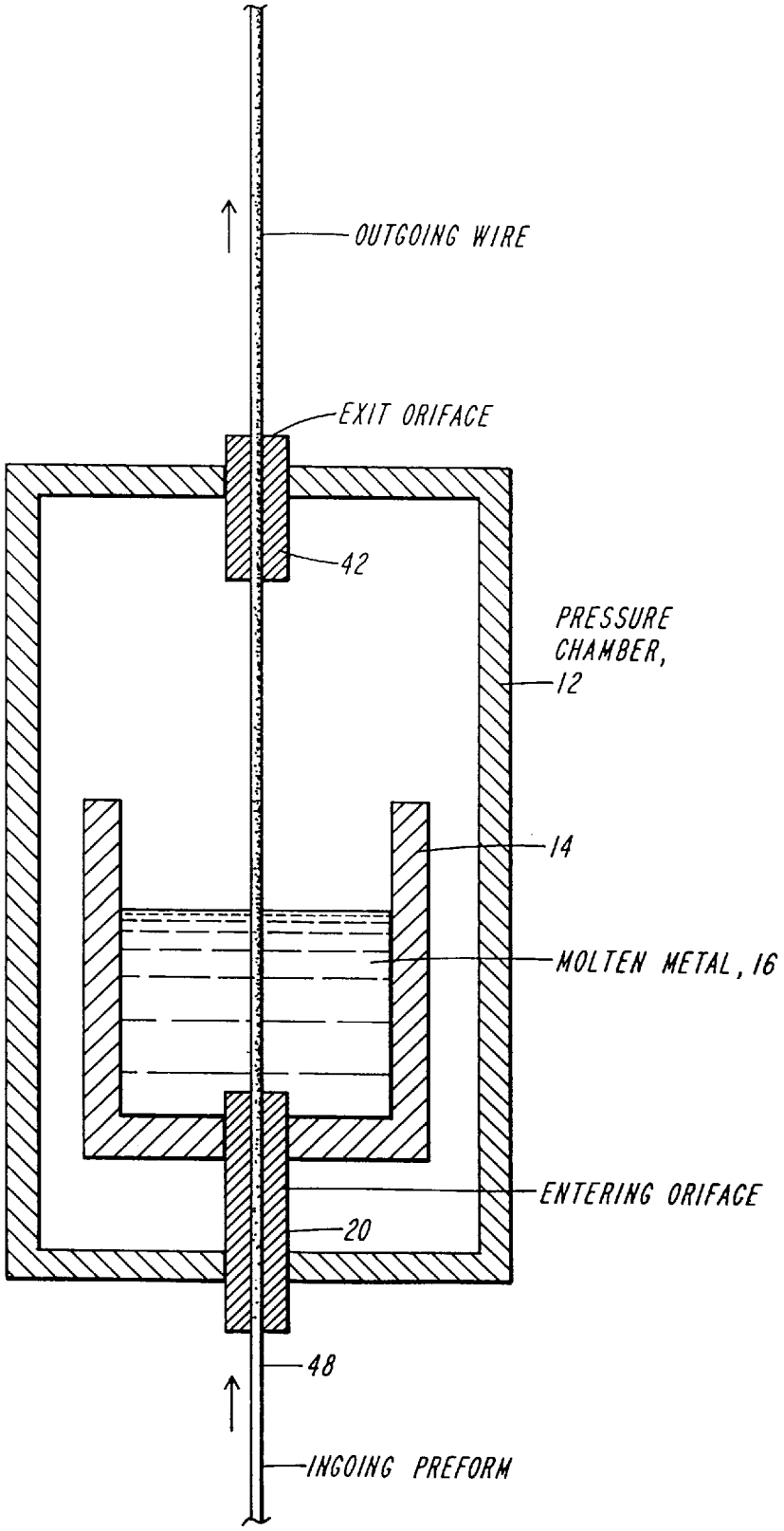
FIG. 3 is a schematic cross-sectional view of a further embodiment of the gating system for the continuous pressure infiltration process of the present invention.
Figure 4:
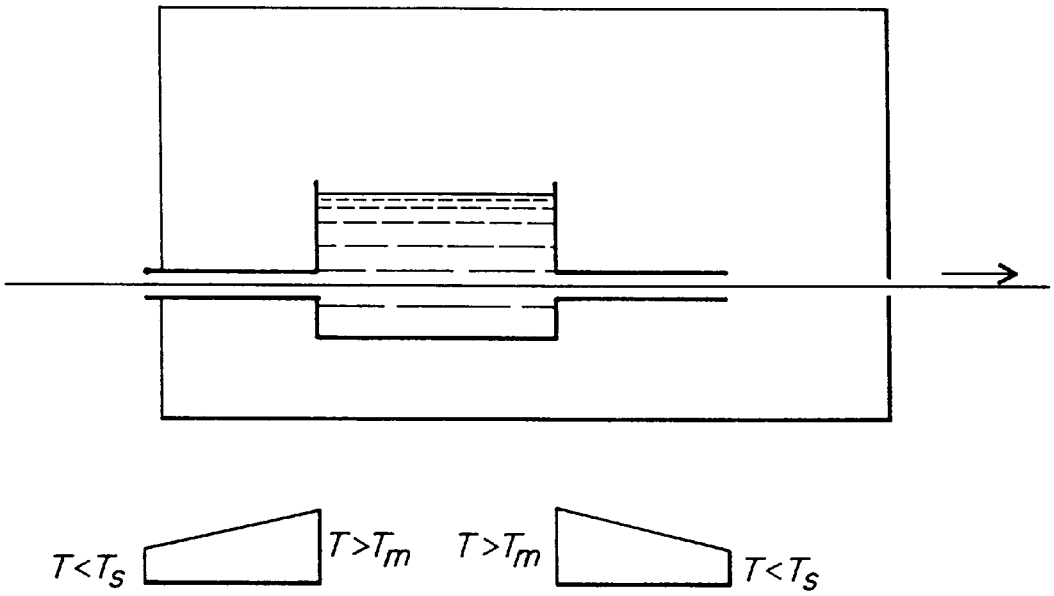
FIG. 4 is a schematic cross-sectional view of a still further embodiment of the gating system for the continuous pressure infiltration process of the present invention, in which high frictional forces between an infiltrated perform and the exiting orifice can lead to failure of the perform.

In a further embodiment, the first exiting orifice can take the form of a sufficiently long free path in the pressurized gas environment after exiting the infiltration bath, as shown in FIG. 3. However, without the elongated, conforming structure of the first exiting orifice, the cross-section of the infiltrated perform is not consistent and the surface quality is reduced, since the perform tends to drag out slag formed on top of the bath.

EXAMPLE

Figure 5:
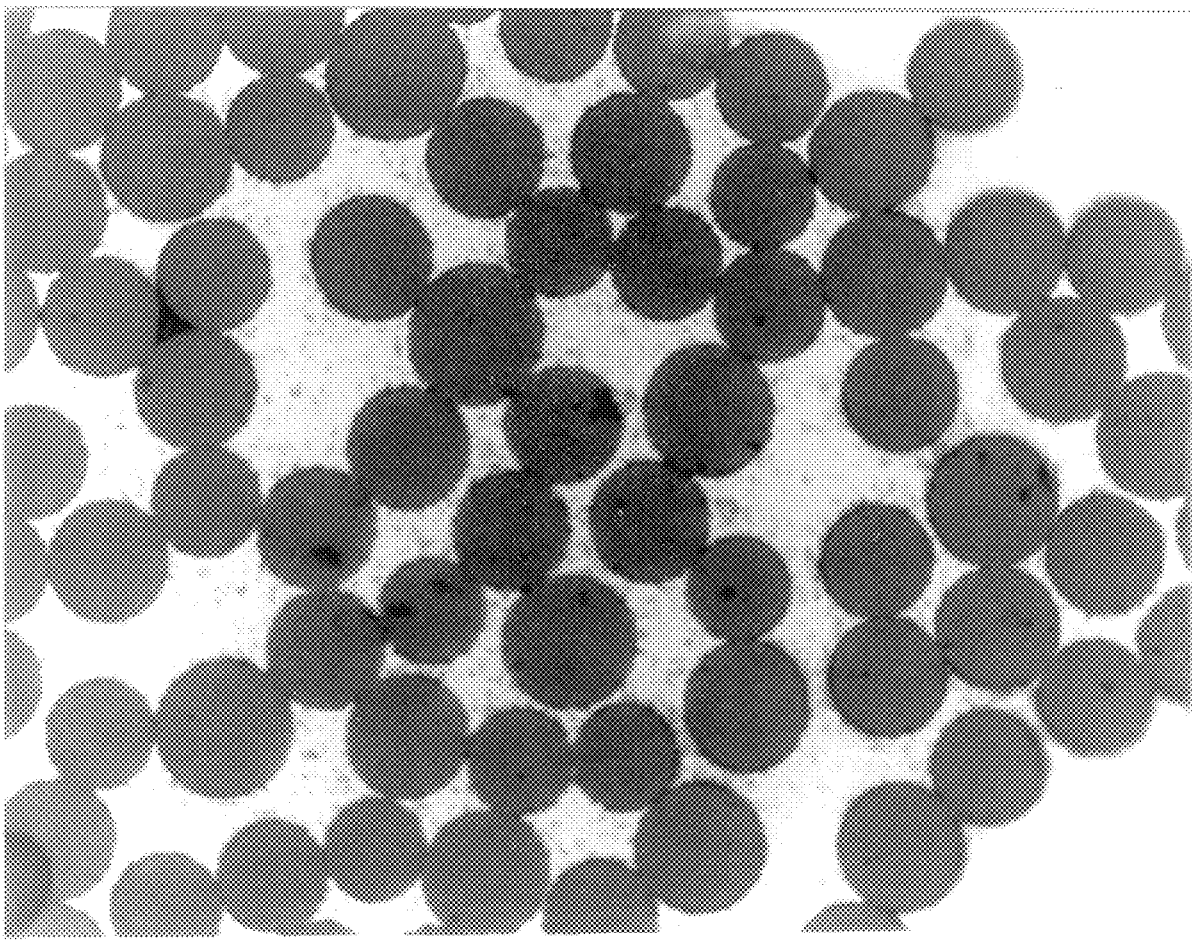
FIG. 5 is a photomicrograph at magnification of 960 X of a wire produced according to the present invention.

Several experiments were carried out using 20 tows of NEWEL 610 fiber collimated into 0.06 inch diameter bundles. The molten metal in the bath was aluminum and the diameter of the entering orifice was 0.06 inch, the same diameter as the fiber bundles. The solidification exiting orifice had diameters ranging from 0.06 to 0.064 inch, and the final or sealing exit orifice had diameters ranging from 0.062 to 0.065 inch. The fibers traveled at a speed of 6 in/sec. The infiltration pressure was varied up to 1000 psi. The infiltrated fibers passed through the exiting orifices without any difficulties. The length of wire produced was limited only by handling space limitations. Optical microscopy of the produced wires showed excellent infiltration. See FIG. 5. The mechanical properties were good as well, with an ultimate strength better than 195,000 PSI.

The gating system of the present invention is applicable for continuous pressure infiltration processes for producing a wide variety of long pieces, such as wires, tapes, sheets, or tubes. The orifices are configured to conform to the desired configuration. The fiber reinforcing materials are typically ceramics, such as aluminum oxide and silicon carbide, or graphite, or metal such as tungsten. Preferred properties of the reinforcing materials include high strength, high Young's modulus, and good stability at high temperatures. Suitable matrix metals include aluminum, titanium, magnesium, copper, superalloy, nickel, chromium, cobalt, zinc, or lead. However, almost any metal or metal alloy is a matrix material candidate.

The invention is not to be limited by what has been particularly shown and described, except as indicated by the appended claims.

I claims:

1. A system for continuous pressure infiltration of a fiber perform with a matrix material comprising:

a pressure chamber to provide a pressurized environment;

a bath container disposed within the pressure chamber, the bath container including a heating element to maintain the matrix material in the bath container at a temperature above its melting temperature;

an elongated entering orifice for sealing against liquid pressure, the orifice extending from an inlet at a lower surface of the pressure chamber to an outlet at a lower surface of the bath container to introduce the fiber perform into the bath container, a length of the entering orifice selected to provide a temperature gradient in the entering orifice, the temperature gradient selected to maintain the matrix material in the entering orifice in an entirely solid state at a location farthest from the bath container, in an entirely liquid state closest to the bath container, and in both the liquid and solid states therebetween;

an exiting orifice for sealing against gas pressure disposed at an upper surface of the pressure chamber to allow the fiber perform infiltrated with the matrix material out of the pressure chamber; and wherein the pressure chamber has a region between a top of the bath container and the exiting orifice sufficient to cause the matrix material infiltrating the perform to fully solidify prior to exiting the pressure chamber through the sealing, exiting orifice.

2. The system of claim 1, further comprising a further, elongated exiting orifice at the top of a molten bath of the matrix material in the bath container, the further exiting orifice having a length selected to provide a temperature gradient in the further exiting orifice, the temperature gradient selected to maintain the matrix material in the further exiting orifice in an entirely liquid state closest to the bath and in both the liquid and solid states farthest from the bath, whereby the matrix material infiltrating the fiber perform is not fully solidified upon leaving the further exiting orifice.

3. The system of claim 2, wherein an inlet of the further exiting orifice is disposed within the molten bath.

4. The system of claim 2, wherein the further exiting orifice floats on the surface of the bath.

5. The system of claim 2, wherein the further exiting orifice is fixed to the bath container.

6. The system of claim 2, further comprising a cooling jacket around the further exiting orifice.

7. The system of claim 2, wherein the cross-sectional configuration of the further exiting orifice is selected to conform to a cross-sectional configuration of the fiber perform to be infiltrated.

8. The system of claim 1, further comprising a cooling jacket around the entering orifice.

9. The system of claim 1, wherein the cross-sectional configuration of the entering orifice is selected to conform to a cross-sectional configuration of the fiber perform to be infiltrated.

10. The system of claim 1, wherein the cross-sectional configuration of the sealing, exiting orifice is selected to conform to a cross-sectional configuration of the fiber perform to be infiltrated.

11. The system of claim 1, wherein the length of the sealing exiting orifice is selected to provide a seal for the pressure chamber to reduce gas losses.

* * * * *

UNITED STATES PATENT AND TRADEMARK OFFICE

CERTIFICATE OF CORRECTION

PATENT NO. : 6,035,925
DATED : March 14, 2000
INVENTOR(S) : Joseph T. Blucher

It is certified that error appears in the above-identified patent and that said Letters Patent is hereby corrected as shown below:

Title page,
Item [57], ABSTRACT,
Lines 4, 5, 11, 19 and 25, "perform" should read -- preform --;

Column 1,
Line 10, "performs" should read -- preforms --;
Lines 16, 17, 18, 20, 22, 32, 39, 50, 54, 55, 57, 63 and 66, "perform" should read -- preform --;
Line 48, "farthest. From the bath.", should read -- farthest from the bath. --

Column 2,
Lines 1, 2, 4, 10, 14, 15, 20, 22, 28, 34, 37, 42, 59 and 60, "perform" should read -- preform --;
Line 6, "perform are reduced. More specifically, the perform" should read -- preform are reduced. More specifically, the preform --;
Line 12, "liquids" should read -- liquidus --;
Line 13, "solids" should read -- solidus --;
Lines 29 and 30, "per-form" should read -- pre-form --;

Column 3,
Lines 18, 48 and 50, "liquids" should read -- liquidus --;
Lines 19 and 50, "solids" should read -- solidus --;
Line 40, "perform" should read -- preform --;

Column 4,
Lines 3, 5, 8, 11, 13, 19, 23, 27, 29, 35, 36, 38, 39, 41, 43, 51 and 52, "perform" should read -- preform --;
Line 58, "NEWEL" should read -- NEXTEL --;

Column 5,
Line 15, "superalloy," should read -- superalloys, --;
Lines 23 and 33, "perform" should read -- preform --;

UNITED STATES PATENT AND TRADEMARK OFFICE

CERTIFICATE OF CORRECTION

PATENT NO. : 6,035,925
DATED : March 14, 2000
INVENTOR(S) : Joseph T. Blucher

It is certified that error appears in the above-identified patent and that said Letters Patent is hereby corrected as shown below:

Column 6,
Lines 1, 5, 16 and 34, "perform" should read -- preform --;
Lines 28, 29, 38 and 39,"per-form" should read -- pre-form --.

Signed and Sealed this

Fourteenth Day of May, 2002

*Attest:*

*Attesting Officer*

JAMES E. ROGAN
*Director of the United States Patent and Trademark Office*